United States Patent [19]

Söderström

[11] 4,255,909

[45] Mar. 17, 1981

[54] MANHOLD

[76] Inventor: Gert Söderström, Hammarbyvägen 62, Upplands Väsby, Sweden, S-194 00

[21] Appl. No.: 957,051

[22] Filed: Nov. 3, 1978

[30] Foreign Application Priority Data

Nov. 7, 1977 [SE] Sweden ..... 7712565

[51] Int. Cl.[3] ..... E02D 29/14

[52] U.S. Cl. ..... 52/20; 404/26

[58] Field of Search ..... 52/19–21, 52/112, 111, 67; 404/25, 26; 220/8

[56] References Cited

U.S. PATENT DOCUMENTS

| | | | |
|---|---|---|---|
| 80,776 | 8/1868 | Smith | 220/8 |
| 193,686 | 7/1877 | Bowers | 220/8 |
| 358,696 | 3/1887 | Reichert | 220/8 |
| 1,131,687 | 3/1915 | Eiber | 220/8 |
| 1,409,905 | 3/1922 | Bayles | 52/112 |
| 2,049,645 | 8/1936 | Fleckles | 220/8 |
| 2,877,505 | 3/1959 | Stephens | 220/8 |
| 3,346,230 | 10/1967 | Tolf | 220/8 |
| 3,629,981 | 12/1971 | McCaffery | 52/20 |

FOREIGN PATENT DOCUMENTS

| | | | |
|---|---|---|---|
| 39843 | 9/1973 | Australia | 404/26 |
| 1389022 | 1/1965 | France | 404/26 |

*Primary Examiner*—Price C. Faw, Jr.
*Assistant Examiner*—Henry E. Raduazo
*Attorney, Agent, or Firm*—Schuyler, Banner, Birch, McKie & Beckett

[57] ABSTRACT

An adjustable manhole is disclosed having telescoping tubular members which can be fixed in a number of relative axial positions. One member carries a series of transversely oriented ribs and grooves in the interface between the members, and the other member carries a smooth wall in the interface. Locking means are engageable in selected grooves to fix the relative positions of the members.

9 Claims, 3 Drawing Figures

MANHOLD

This invention relates to a manhole, which is especially used to make possible cleaning and inspection of collection wells, leaching cesspools or other cesspools arranged in a safe, unfrozen ground.

Manholes have so far consisted of prefabricated concrete pipe elements, which have been dimensioned to absorb earth pressure as well as pressures exerted from above on the associated well covers. The latter pressures may often be considerable, as wells of this type are often disposed in streets and roads. As a consequence of this the dimensions of the concrete pipes will be very big in order to absorb the necessary loads without cracking. These forces are transferred from the very manhole to the bottom of the well and the underlying strata of earth. As the concrete pipes are prefabricated a great amount of different pipe lengths are required for adaptation to different depths. As a consequence of the weight of the included elements much equipment is required for mounting as well as space for mounting and storage.

These wells will therefore be relatively expensive, which results in that it is tried to economize as much as possible, as far as these pipes are concerned, when municipal sewers are laid. The consequence of this will be, in its turn, that not all premises will be directly connected to collection wells or soakaways but instead connected via branchings, which causes trouble in cleaning as a consequence of stoppages in sinks.

It is therefore the object of the invention to provide a manhole, which is substantially cheaper than the constructions so far known and which, moreover, require little space of storage and transport and allow a simple adaptation to different depths.

This is achieved according to the invention by the manhole pit consisting of elements that can be telescopically pushed into each other and have flanges or ribs and grooves on their outer sides along an essential portion of their lengths, said flanges or grooves extending all around and in which inserts possible to place against underlying portions can engage to fix the parts reciprocally. This design of the manhole of the invention can be realized with advantage with elements made of plastic, which will additionally simplify handling of the included parts.

According to another characteristic feature of the invention this is provided with an unloading means from the cover at its upper end at surrounding earth strata instead of transferring the forces directly to the very manhole. This will substantially reduce the required strength of the included parts, as they need only be dimensioned in respect of the existing earth pressure and not considering vertical loads from above.

The invention will be described below more in detail in the form of an illustrative example in connection with the drawings.

Figure 1:
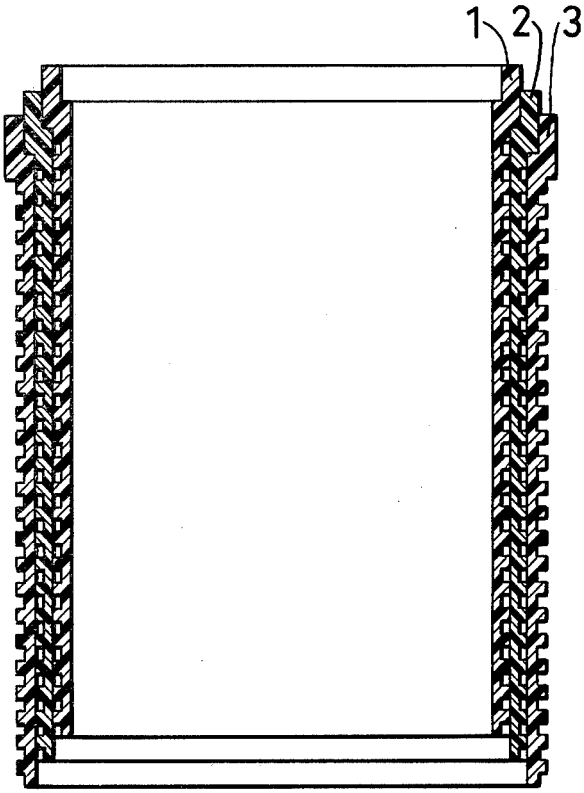

FIG. 1 shows the telescopic pipes according to the invention in a pushed together state.

Figure 2:
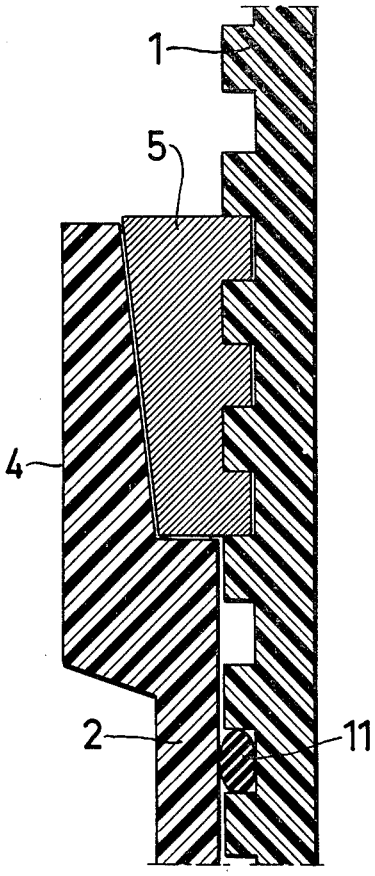

FIG. 2 a part section of two telescopic pipes drawn apart with locking by means of an insert.

Figure 4:
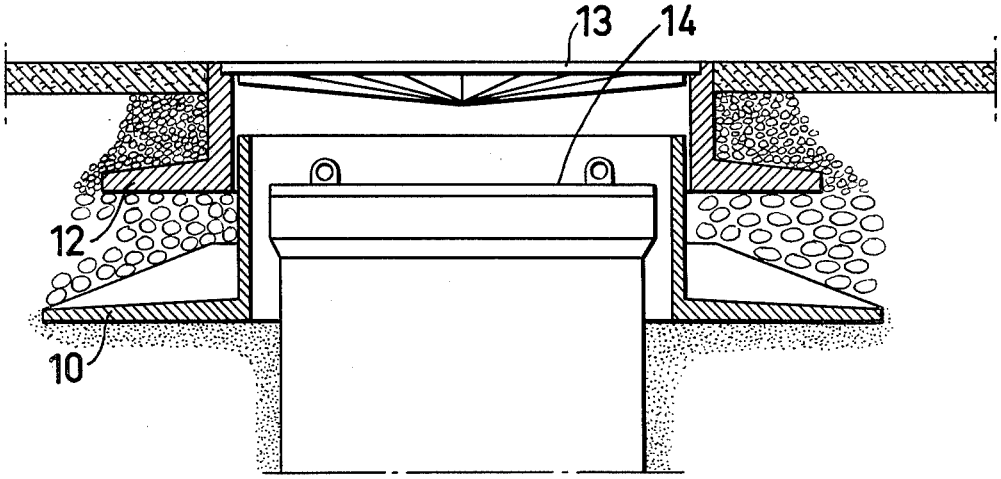
Figure 3:
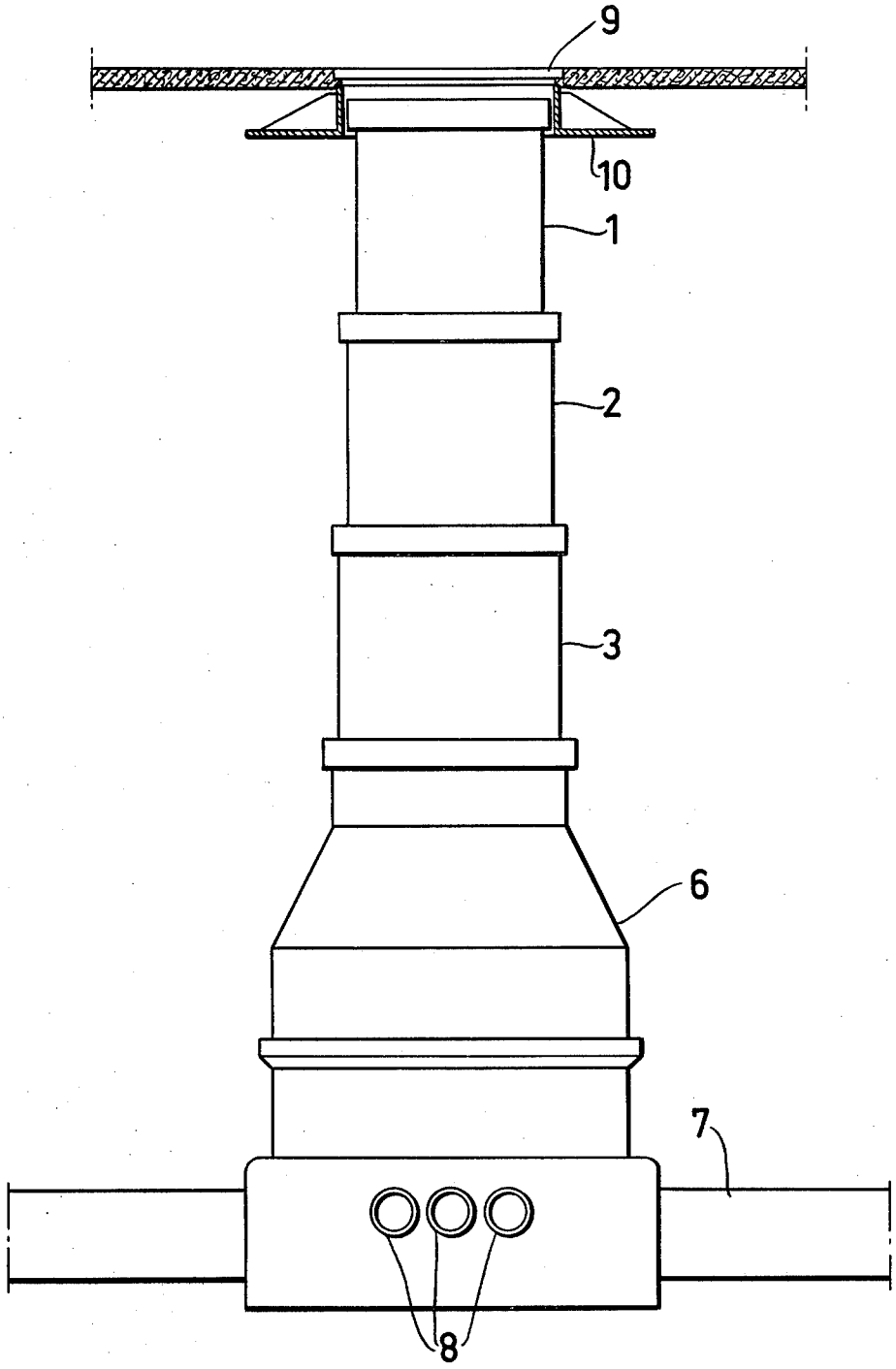

FIG. 3 the manhole according to the invention mounted over a collection well and FIG. 4 examples of unloading.

As is apparent from FIG. 1 the subject matter of the invention includes in this case three plastic pipe portions 1, 2 and 3, which can be pushed into each other telescopically and are provided on their outer sides with rectangularly recessed grooves with intermediate rectangular flanges. It is shown in FIG. 2 between two pipes 1 and 2 how an insert 5 with a profiled corresponding to the profile of the outside of the pipe 1 is inserted in a flared portion or locking recess 4 on the lower pipe 2 to fix the upper pipe 1 with respect to the lower one. The insert 5 is semicircular and two such inserts or segments are used for locking each pipe. In order to support fixing additionally the inserts 5 and their associated flared portion 4 can be conically bevelled on the surfaces facing each other to obtain a certain tension effect against the inner upper pipe 1. Moreover, in FIG. 2 it is shown how a sealing ring 11 has been inserted in a groove on the inner pipe for sealing against the smooth inside of the outer pipe.

In FIG. 3 the telescopic rings 1, 2 and 3 of the well are mounted on a collection well 6, which is connected to a main line 7 and connections 8 from e.g. separate premises. The telescopic parts 1, 2 and 3 are fixed reciprocally and relative to the collection well 6 in the way shown in FIG. 2. In the upper end of the manhole this is surrounded by a pressure absorbing plate 10, which absorbs and distributes the load from the well cover 9 to earth strata surrounding the manhole. The upper end of the manhole may thus slide up and down in the unloading ring of the well cover. In this way the upper portion of the well can be adapted e.g. when new covering is laid on the road. Should this motion not be enough it is possible to release the associated inserts by lifting one of the telescopic pipes and make the necessary vertical adjustments.

By not loading the manhole with anything else than earth pressure the collection well 6 need not be made of concrete, either, but this can with advantage be made of plastic with the cups of the connections 8 pressed integrally with the well bottom, a technique which has not been possible before as a consequence of the great forces that must be absorbed by the collection well. Moreover, in this way easier connections to all the conduits are obtained, as these today generally are made of plastic.

When transporting collection well and telescopic pipes the latter can, moreover, with advantage be pushed into the collection well.

It is easily realized that a result of the invention is almost a whole system of elements, which are compact in transport and storage, and that a minimum of different parts need be stored. Furthermore, the manhole of the invention will be easily and quickly assembled, cheap in manufacture and more flexible as a result of the greater elasticity of the plastic as compared with concrete and, consequently less apt to leakage than the constructions so far known.

It should be observed that the profile of the inserts and the outer sides of the pipes, respectively, need not be square but can have other shapes, such as a trapezoid, triangular etc. The different well rings need not be circular, either, but it is possible to let them be rectangular, it being necessary to manufacture only one insert size provided the same groove profile for all pipes is used. On the other hand, the circular variant is to be preferred for strength technical reasons. Within the scope of the invention it is also possible to have different groove distances of the different telescopic pipes, which should make possible a better fine adjustment of the height of the finished well. Nor is it necessary for the inventive idea that all the included telescopic parts are provided with grooves on their whole length, but it is only essential that the rings have a sufficient amount of grooves to allow the required adjusting possibilities.

By means of the invention it is also possible to simplify plumbing in houses by collecting instead of branchings all sewers to a common collection well, which is connected to floor level by means of the manhole of the invention to make possible cleaning. In this way the cleaning is also essentially simplified. Moreover, in this way it is possible to eliminate cleaning pits in concrete, which are expansive and time-consuming to cast as wall as to handle in cleaning.

The unloading of the upper end of the well can also take place in the way shown in FIG. 4 with an upper unloading ring 12 and a lower one 10, which can slide relative to each other, it being possible to adapt the upper one 12 to the street level. The cover 13 is arranged in the upper ring 12, while another cover 14 is arranged in the upper ends of the very manhole to reduce the risk of water entering this way. However, the covers should be provided with air holes to avoid negative pressure in the well.

What I claim is:

1. An adjustable manhole comprising:

at least two telescoping tubular members adapted to line a subterranean pit;

an alternating series of ribs and grooves carried by one of said tubular members in the interface between said tubular members, said ribs and grooves being uninterrupted and extending completely around said interface transversely of the longitudinal axes of said tubular members;

a smooth continuous wall carried by the other of said tubular members in said interface opposed to said ribs and grooves permitting free relative axial movement of said tubular members; and locking means engageable in at least one of said grooves to fix the relative axial positions of said tubular members, said locking means comprising a continuous locking recess carried by said other tubular member extending completely around said interface, and a locking member engageable in said locking recess and in at least one of said grooves.

2. A manhole according to claim 1 wherein said tubular members are made of plastic.

3. A manhole according to claim 1 wherein said locking member extends completely around said interface to fill said groove and said locking recess.

4. A manhole according to claim 3 wherein said locking member comprises two separate locking segments which together fill said groove and said locking recess.

5. An adjustable manhole comprising:

at least two telescoping tubular members adapted to line a subterranean pit;

an alternating series of ribs and grooves carried by the exterior surface of the inner one of said tubular members in the interface between said tubular members, said ribs and grooves being uninterrupted and extending completely around said interface transversely of the longitudinal axes of said tubular members;

a smooth continuous wall carried by the inner surface of the outer one of said tubular members in said interface opposed to said ribs and grooves permitting free relative axial movement of said tubular members; and locking means engageable in at least one of said grooves to fix the relative axial positions of said tubular members, said locking means comprising a locking recess at the top of said outer tubular member facing the ribs and grooves of said inner tubular member, and a locking member engageable in said locking recess and in at least one of said grooves.

6. A manhole according to claim 5 wherein said locking recess is continuous and completely surrounds said inner tubular member.

7. A manhole according to claim 6 wherein said locking member extends completely around said inner tubular member to fill said groove and said locking recess.

8. A manhole according to claim 7 wherein said locking member comprises two separate locking segments which together fill said groove and said locking recess.

9. A manhole according to claim 8 wherein said locking recess tapers inwardly from the upper edge of said outer tubular member and said locking segments are correspondingly tapered so as to be wedged into said locking recess.

* * * * *